United States Patent [19]

Smulders

[11] Patent Number: 4,642,521

[45] Date of Patent: Feb. 10, 1987

[54] COMPACT IGNITER FOR DISCHARGE LAMPS

[75] Inventor: Herman Smulders, Arlington Heights, Ill.

[73] Assignee: Advance Transformer Company, Chicago, Ill.

[21] Appl. No.: 684,448

[22] Filed: Dec. 21, 1984

[51] Int. Cl.[4] ..... H05B 39/04

[52] U.S. Cl. ..... 315/106; 315/309

[58] Field of Search ..... 315/100, 104, 106, 309, 315/200 R, 207

[56] References Cited

U.S. PATENT DOCUMENTS

| | | | |
|---|---|---|---|
| 4,087,723 | 5/1978 | Chermin et al. | 315/207 |
| 4,253,043 | 2/1981 | Chermin et al. | 315/101 |
| 4,380,719 | 4/1983 | DeBijl | 315/207 |
| 4,406,976 | 9/1983 | Wisbey et al. | 315/309 |

*Primary Examiner*—David K. Moore

*Attorney, Agent, or Firm*—Robert T. Mayer; Bernard Franzblau

[57] ABSTRACT

A ballast-inverter circuit for a discharge lamp with preheatable electrodes. The lamp is connected to the supply voltage input terminals via a ballast impedance. A triac provides a preheat current path for the lamp electrodes and has a gate electrode connected to an RC timing circuit. A PTC resistor is coupled between one input terminal and the timing circuit to trigger the triac so as to heat up the lamp electrodes and assist the lamp to ignite. The PTC resistor heats up until its resistance is so high that the timing circuit is no longer able to trigger the triac into conduction. The electrode preheat circuit is effectively disconnected from the lamp electrodes when the lamp is in operation.

13 Claims, 1 Drawing Figure

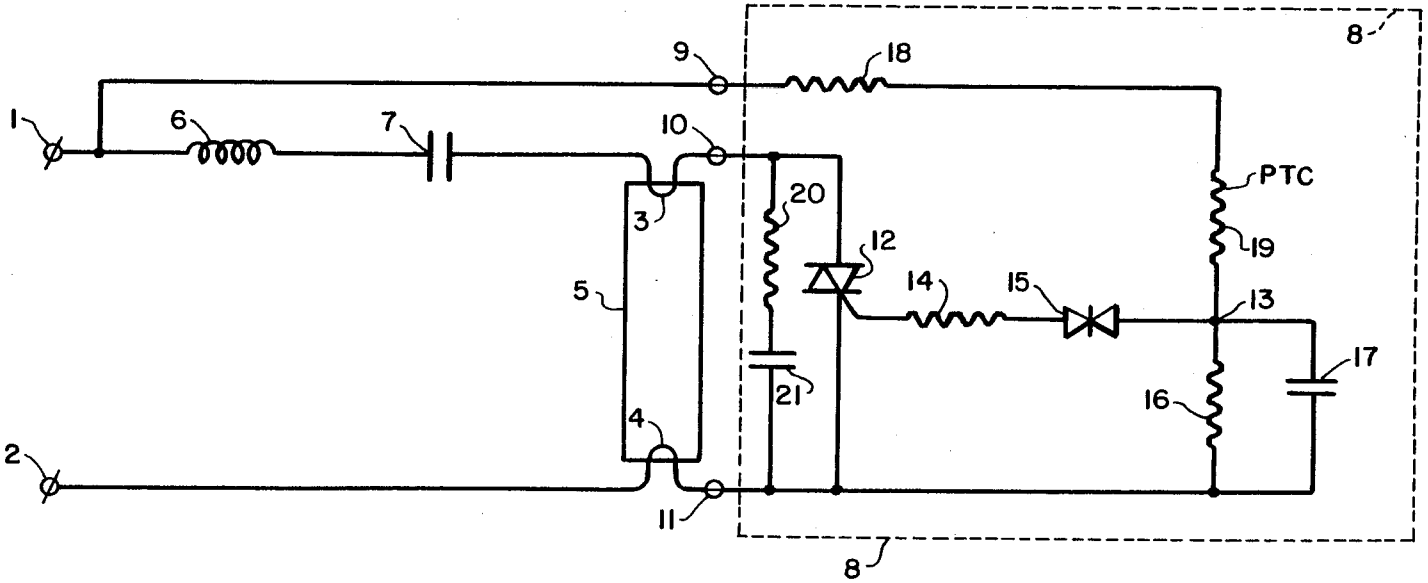
8
PTC
19
13
17
16
15
14
12
18
20
21
8
9
10
3
4
11
5
7
6
1
2

COMPACT IGNITER FOR DISCHARGE LAMPS

BACKGROUND OF THE INVENTION

This invention relates to an electric arrangement for starting and operating an electric discharge lamp and, more particularly, to a compact igniter circuit for a discharge lamp of the type having preheatable electrodes.

It is known to use a glow discharge starter device for igniting discharge lamps. This results in a simple and inexpensive igniter device which is relatively reliable in operation. However, a glow discharge starter will not work well in situations where the lamp operating voltage is relatively close to the nominal AC supply voltage. For example, in the case of a discharge lamp with an arc voltage of 90 volts intended for use with a 115 volt AC supply voltage, the conventional glow discharge starter device will not provide reliable lamp ignition, although operation of such a lamp from a 220 volt AC supply voltage is quite reliable. In other words, a glow discharge starter device operates well if there is a relatively large difference between the nominal value of the line voltage and the characteristic lamp operating voltage.

One solution to this problem is to use an electronic igniter-ballast circuit in place of the glow discharge starter. A disadvantage of this solution is that the electronic igniter-ballast circuit is more expensive than a ballast-igniter circuit that utilizes a glow discharge starter device.

An electronic igniter-ballast apparatus for starting and operating one or more discharge lamps wherein the total arc voltage of the tube(s) differs only a little from the AC supply voltage is described in U.S. Pat. No. 4,253,043 issued 2/24/81 to Chermin et al. This apparatus includes a bidirectional controlled semiconductor switching element connected in series with a PTC resistor across the preheatable electrodes of the discharge tube(s). A VDR element is connected in a control circuit of the semiconductor switching element to ensure that the discharge tube(s) does not ignite before the tube electrodes are heated sufficiently. The PTC resistor heats up to limit the current flow through the preheatable electrode if the discharge tube(s) fails to ignite.

U.S. Pat. No. 4,087,723 issued 5/2/78 to Chermin et al describes an arrangement for starting and operating a discharge lamp provided with cold electrodes. A capacitor, a PTC resistor and a controlled bidirectional semiconductor switching element are serially connected across the lamp electrodes to form a starter circuit for the lamp. If the lamp fails to ignite, the PTC resistor heats up and switches over to its high resistance state so that the arrangement produces substantially no radio interference.

A circuit arrangement for starting and operating a discharge lamp by means of an electronic ballast is described in U.S Pat. No. 4,358,711, 11/9/82 in the name of H. Bex. This circuit includes an electronic switch (transistor) in series with the lamp to act as a ballast to limit the lamp operating current. A series circuit consisting of a PTC resistor and an ohmic resistor is connected in parallel with the electronic switch, with only the PTC resistor connected in parallel with a control circuit of the electronic switch. The PTC resistor and ohmic resistor allow line frequency current to flow through the lamp electrodes for approximately ½ to 1 second to preheat the electrodes. The PTC resistor heats up, changes its resistance state, thereby initiating high frequency operation of the electronic switch and ignition of the discharge lamp.

It is also known to use a PTC resistor in combination with a glow discharge starter device for igniting and operating a discharge lamp. U.S. Pat. No. 3,740,609 issued 6/19/73 to J. C. Moerkens describes such an arrangement for igniting a discharge lamp which has such a high ignition voltage that it cannot be ignited properly by means of a conventional glow discharge starter. The glow discharge starter is connected in series circuit with the lamp ballast and the preheatable electrodes of the lamp across the supply voltage terminals. A diode and a PTC resistor are serially connected in shunt with the lamp to effect a voltage doubling that promotes ignition of the lamp. After the lamp ignition, the PTC resistor heats up and effectively renders the diode branch circuit inoperative.

Another PTC resistor and glow discharge starter combination for operation of a discharge lamp is shown in U.S. Pat. No. 4,208,616 issued 6/17/80 in the name of J. C. Moerkens. The PTC resistor is connected in series with the glow discharge starter in the preheat circuit of the lamp electrodes. The PTC resistor receives current only during the starting procedure of the lamp and will not switch over to its high resistance state if the lamp ignites normally. If the lamp does not ignite, the PTC resistor heats up and switches to its high resistance state and thereby limits the current in the lamp ballast and the lamp electrodes to a safe value.

SUMMARY OF THE INVENTION

It is therefore an object of the invention to provide a compact and inexpensive apparatus for starting and operating an arc discharge lamp.

Another object of the invention is to provide an igniter-ballast circuit for an arc discharge lamp that utilizes a PTC resistor instead of a glow discharge starter.

It is a further object of the invention to provide a simple igniter-ballast circuit for an arc discharge lamp with preheatable electrodes that uses a PTC resistor in a novel circuit configuration to control the preheat time of the lamp electrodes and to automatically disconnect or switch off the electrode preheat circuit when the lamp ignites.

A further object of the invention is to provide a three-point igniter circuit for a discharge lamp with preheatable electrodes which igniter circuit uses a PTC resistor to prevent lamp ignition with cold electrodes and which aids in the generation of high voltage ignition pulses that ignite the lamp after the electrodes warm up.

The novel ballast-inverter circuit comprises a discharge lamp of the type having preheatable electrodes connected in series with a ballast device across a pair of input terminals adapted to be connected to a conventional source of AC supply voltage (e.g. 115 V at 60 Hz). A bidirectional controlled semiconductor device is connected to the lamp electrodes to provide a preheat current path for the electrodes. A control circuit including an RC timing circuit is coupled to a control electrode of the semiconductor device. A PTC resistor is coupled between one of the input terminals and the control circuit so as to allow the control circuit to trigger the semiconductor device into conduction to provide preheat current through the lamp electrodes. After a short time the lamp ignites as the PTC resistor heats up. The resistance of the PTC resistor subsequently becomes so high that the control circuit is unable to trigger the semiconductor device into conduction. The electrode preheat circuit is then effectively disconnected from the lamp electrodes so long as the lamp is in operation and the supply voltage is applied to the input terminals.

An important advantage of this ballast-igniter circuit is that it avoids the limitations of the glow starter devices which require a relatively large difference between the lamp arc voltage and the line supply voltage.

Another advantage of the invention is that it provides a good preheat current for the lamp electrodes and a good starting voltage for igniting the lamp.

BRIEF DESCRIPTION OF THE DRAWINGS

The invention, together with further objects and advantages thereof will become apparent by reference to the following detailed description taken in conjunction with the accompanying drawing, the sole figure of which illustrates a preferred embodiment of the ballast-igniter circuit for an arc discharge lamp.

DETAILED DESCRIPTION OF THE DRAWINGS

The drawing shows a ballast-igniter circuit having a pair of input terminals 1, 2 for connection to a source of AC supply voltage of, for example, 115 volts, 60 Hertz. Terminal 1 is connected to a first preheatable electrode 3 of an arc discharge lamp 5, for example, a low-pressure mercury discharge lamp, via a ballast device consisting of an inductor 6 connected in series with a capacitor 7. The other input terminal 2 is directly connected to the other lamp electrode 4.

An igniter circuit 8 has a first input terminal 9 connected to input terminal 1. The igniter circuit also has second and third input terminals, 10 and 11, respectively, connected to lamp electrodes 3 and 4, respectively.

A bidirectional controlled semiconductor device 12, for example, a triac, is connected across the input terminals 10 and 11 of the igniter circuit. The gate or control electrode of triac 12 is connected to a circuit junction point 13 via the series connection of a resistor 14 and a bidirectional diode (Diac) 15 having a predetermined voltage threshold level.

The circuit junction point 13 is connected to input terminal 11 of the igniter circuit via a parallel RC timing circuit consisting of a resistor 16 connected in parallel with a timing capacitor 17. A resistor 18 is connected in series with a positive temperature coefficient (PTC) resistor 19 between input terminal 9 of the igniter circuit and circuit junction point 13.

A resistor 20 and a capacitor 21 are connected in series across the main electrodes of the triac 12. The capacitor 21 suppresses radio frequency interference and increases the peaks of the voltage pulses. The resistor 20 limits the flow of discharge current from capacitor 21 when the triac is triggered into conduction.

Upon the application of the AC line voltage, e.g. 115 V, 60 Hz, to input terminals 1, 2, the capacitor 17 in the gate control circuit of triac 12 begins to charge up via resistor 18 and PTC resistor 19, the latter resistor being initially low ohmic. The triac 12 is initially in a cut-off state. Since the resistance of PTC resistor 19 is then low, the capacitor 17 is able to charge up to the breakdown voltage of the Diac 15. The triac 12 is then triggered into conduction to provide a preheat current path for the lamp electrodes that consists of input terminal 1, inductor 6, capacitor 7, electrode 3, triac 12, electrode 4 and input terminal 2.

During the electrode preheat period the PTC resistor begins to heat up and to increase its resistance. As the PTC resistor heats up, the time required to charge the capacitor 17 to the breakdown voltage of Diac 15 increases so that the firing angle of triac 12 is shortened in each half cycle of the 60 Hz AC supply voltage. As a result, high starting voltage pulses will be developed across the lamp 5 which increase in amplitude as the PTC resistor increases its resistance. After approximately ½ to 1 second, the starting voltage pulses will build up to a level which will ignite the lamp. This is sufficient time to heat up the lamp electrodes to their operating temperature.

After a short heat up time the PTC resistor switches over to its high resistance state. At that time, the resistance of the PTC resistor is so high that the capacitor 17 can no longer charge up to the breakdown voltage of Diac 15 during each half cycle of the 60 Hz AC supply voltage at input terminals 1 and 2. As a result, the triac 15 will no longer be triggered into conduction. The current flow through the PTC resistor 19 is sufficient to maintain it in the high resistance state so that the triac 12 is held in the cut-off state. The igniter circuit is therefore effectively deactivated during the operating state of the lamp 5 so that high voltage ignition pulses are not generated after the lamp goes into operation (conduction).

The resistor 18 in series with the PTC resistor 19 provides a more symmetrical current flow through the lamp electrodes 3 and 4 and thus reduces any tendency for one end of the lamp (e.g. adjacent electrode 3) to begin to blacken before the other. This will extend the useful life of the lamp.

The PTC resistor 19 also provides a protective feature in that if the lamp fails to ignite, the PTC resistor will heat up and switch over to its high resistance state, thus inhibiting the conduction of triac 12 and thereby preventing the flow of current to the electrodes of the non-ignited lamp.

It will be apparent from the foregoing description that I have invented a simple, inexpensive and reliable ballast-igniter circuit for arc discharge lamps that will provide the various advantages described and will derive the objects specified above. It also will be understood that various modifications to the above-described ballast-igniter circuit will become evident to persons skilled in the art without departing from the spirit and scope of the invention as defined in the appended claims.

I claim:

1. A ballast-igniter apparatus for an arc discharge lamp of the type having preheatable electrodes comprising:

a pair of input terminals for supplying an AC voltage to the apparatus, a ballast impedance for connection in series with said discharge lamp across said input terminals, a controlled semiconductor switching device having a control electrode, means for connecting said controlled semiconductor device to the lamp electrodes so that the semiconductor device is connected in series with the ballast impedance and at least one lamp electrode so as to provide a preheat current path for said lamp electrodes, means connecting a positive temperature coefficient (PTC) resistor in series with a timing capacitor across said input terminals, and means including a semiconductor voltage threshold device for coupling the control electrode of the controlled semiconductor device to the timing capacitor so that the capacitor voltage controls the triggering of the controlled semiconductor device, said PTC resistor being operative, prior to ignition of the lamp, to charge the timing capacitor from the voltage at said input terminals so as to trigger the controlled semiconductor device into conduction during each half cycle of the AC supply voltage to provide a preheat current for the lamp electrodes, said PTC resistor changing over to a high resistance state after it heats up whereby the voltage developed across the timing capacitor in each half cycle of the AC voltage is insufficient to trigger the controlled semiconductor device into conduction when the lamp is in its operating state.

2. A ballast-igniter apparatus as claimed in claim 1 further comprising:

a resistor connected in series with the PTC resistor and the timing capacitor across said input terminals.

3. A ballast-igniter apparatus as claimed in claim 1 wherein:

the ballast impedance comprises a serially-connected inductor and capacitor, and further comprising:

a resistor connected in shunt with the timing capacitor.

4. A ballast-igniter apparatus as claimed in claim 1 wherein the controlled semiconductor switching device comprises a bidirectional current device, and the semiconductor voltage threshold device comprises a bidirectional diode device.

5. A three-point igniter device for an arc discharge lamp of the type having preheatable electrodes comprising:

a first input terminal for connection to one terminal of a source of AC supply voltage for the discharge lamp, second and third input terminals for connection to first and second preheatable electrodes, respectively, of a discharge lamp, a controlled semiconductor switching device connected between said second and third terminals, a resistor connected in series circuit with a PTC resistor and a timing capacitor between said first and third input terminals, and a semiconductor voltage threshold device coupling the timing capacitor to a control electrode of the controlled semiconductor switching device.

6. A three-point ingiter device as claimed in claim 5 further comprising:

a second resistor connected in parallel with the timing capacitor.

7. An electronic apparatus for igniting an arc discharge lamp of the type having preheatable electrodes comprising:

a pair of input terminals for supplying an AC voltage to the apparatus, a ballast impedance, means connecting a positive temperature coefficient (PTC) resistor in series with a timing capacitor across said input terminals, a controlled semiconductor switching device having a control electrode, means for connecting said controlled semiconductor device in series with the ballast impedance and at least one of the lamp electrodes across the input terminals so that the semiconductor device will provide a preheat current path for said one lamp electrode, and means including a voltage threshold device for coupling the control electrode of the controlled semiconductor device to the timing capacitor so that the capacitor voltage controls the triggering of the controlled semiconductor device, said PTC resistor being heated during a preheat period prior to ignition of the lamp so as to vary its resistance and thereby vary the timing capacitor charge period so as to vary the trigger point of the semiconductor switching device to vary the firing angle of the semiconductor switching device whereby starting voltages applied to the lamp electrodes will increase during the preheat period.

8. An electronic apparatus as claimed in claim 7 wherein said PTC resistor is heated sufficiently to change over to a high resistance state when the lamp is in its operating state so that the charge period of the timing capacitor is delayed to such an extent that the voltage developed across the timing capacitor is insufficient to trigger the threshold device whereby the semiconductor switching device remains cut-off in the operating state of the lamp.

9. An apparatus for igniting an arc discharge lamp of the type having preheatable electrodes comprising:

a pair of input terminals for supplying an AC voltage to the apparatus, a ballast impedance, means connecting a positive temperature coefficient (PTC) resistor in series with a timing capacitor to one of said input terminals, a controlled semiconductor switching device having a control electrode, means for connecting said ballast impedance, said controlled semiconductor device and at least one of the lamp electrodes in series across said input terminals so that the semiconductor device will provide a preheat current path for said one lamp electrode that excludes the PTC resistor, and means including a voltage threshold device for coupling the control electrode of the controlled semiconductor device to the timing capacitor so that the capacitor voltage controls the triggering of the controlled semiconductor device, said PTC resistor being heated during a preheat period prior to lamp ignition to charge the timing capacitor from the voltage at said one input terminal so as to trigger the controlled semiconductor device into conduction during each half cycle of the AC supply voltage to provide a preheat current for the one lamp electrode prior to ignition of the lamp.

10. An apparatus as claimed in claim 9 wherein the PTC resistor is heated during the preheat period to charge the timing capacitor at a variable rate so as to vary the trigger angle of the controlled semiconductor device and thereby vary the amplitude of starting voltages applied to the lamp electrodes during the preheat period.

11. An apparatus as claimed in claim 9 wherein said PTC resistor heats up and changes over to a high resistance state when the lamp is in its operating state so that the voltage developed across the timing capacitor in each half cycle of the AC voltage remains below the threshold voltage of the voltage threshold device whereby the controlled semiconductor device is maintained in a cut-off condition.

12. A ballast-igniter apparatus as claimed in claim 1 wherein said means connecting the PTC resistor in series with the timing capacitor across said input terminals provides a timing circuit for the semiconductor switching device that triggers the semiconductor switching device independently of the voltage appearing across the lamp electrodes.

13. A three-point igniter device for an arc discharge lamp of the type having preheatable electrodes comprising:

a first input terminal for connection to one terminal of a source of AC supply voltage for the discharge lamp, second and third input terminals for connection to first and second preheatable electrodes, respectively, of a discharge lamp, a controlled semiconductor switching device connected between said second and third terminals, a positive temperature coefficient (PTC) resistor and a timing capacitor connected in series circuit between said first and third input terminals, and a semiconductor voltage threshold device coupling the timing capacitor to a control electrode of the controlled semiconductor switching device, said PTC resistor being operative, during a preheat period prior to ignition of the lamp, to heat up and thereby vary the firing angle of the semiconductor switching device and thereby vary a starting voltage applied to a connected lamp during said preheat period, and wherein the PTC resistor will heat up sufficiently to change over to a high resistance state when a connected lamp is in its operating state thereby to delay the charge period of the timing capacitor for a time period such that a voltage developed across the timing capacitor in each half cycle of the AC supply voltage is below the threshold voltage of the voltage threshold device thereby to inhibit triggering of the semiconductor switching device in the operating state of the lamp.

* * * * *